US011382429B2

(12) United States Patent
Kumazawa

(10) Patent No.: US 11,382,429 B2
(45) Date of Patent: Jul. 12, 2022

(54) BACKREST AND CHAIR

(71) Applicant: AICHI CO., LTD., Nagoya (JP)

(72) Inventor: Taku Kumazawa, Nagoya (JP)

(73) Assignee: AICHI CO., LTD., Nagoya (JP)

( * ) Notice: Subject to any disclaimer, the term of this patent is extended or adjusted under 35 U.S.C. 154(b) by 0 days.

(21) Appl. No.: 17/059,422

(22) PCT Filed: May 29, 2019

(86) PCT No.: PCT/JP2019/021333
§ 371 (c)(1),
(2) Date: Nov. 27, 2020

(87) PCT Pub. No.: WO2019/230815
PCT Pub. Date: Dec. 5, 2019

(65) Prior Publication Data

US 2021/0212470 A1 Jul. 15, 2021

(30) Foreign Application Priority Data

May 30, 2018 (JP) ..... JP2018-103537

(51) Int. Cl.
*A47C 3/12* (2006.01)
*A47C 5/12* (2006.01)
*A47C 7/46* (2006.01)

(52) U.S. Cl.
CPC ..... *A47C 7/46* (2013.01)

(58) Field of Classification Search
CPC ..... A47C 7/20; A47C 7/46
USPC ... 297/446.1–449.1, 452.29–452.37, 452.14, 297/452.15
See application file for complete search history.

(56) References Cited

U.S. PATENT DOCUMENTS 2,961,037 A * 11/1960 Keefer ..... A47C 7/185 297/448.1 X
2,970,638 A * 2/1961 Halter ..... A47C 3/12 297/452.36 X
3,275,371 A * 9/1966 Rowland ..... A47C 4/02 297/446.1 X
3,404,916 A * 10/1968 Rowland ..... A47C 3/04 297/447.3 X
3,583,759 A * 6/1971 Kramer ..... A47C 5/06 297/451.1

(Continued)

FOREIGN PATENT DOCUMENTS

DE 919259 C * 10/1954 ..... A47C 7/20
JP 2007125220 A 5/2007

(Continued)

OTHER PUBLICATIONS

Examination Report No. 1 for Australian Patent Application No. 2019279177, dated Jul. 14, 2021, 3 pages.

(Continued)

*Primary Examiner* — Rodney B White
(74) *Attorney, Agent, or Firm* — Withrow & Terranova, P.L.L.C.; Vincent K. Gustafson

(57) ABSTRACT

A backrest for use in a chair includes a back board arranged in a position to abut a back of a seated person on the chair. A first area that is a laterally central area of the back board has a thickness greater than a thickness of a second area of the back board located closer to each of left and right ends of the back board than the first area.

9 Claims, 10 Drawing Sheets

(56) References Cited

U.S. PATENT DOCUMENTS 3,724,897 A * 4/1973 Faiks ..... A47C 3/04 297/447.3
3,815,955 A * 6/1974 Gibilterra ..... A47C 3/023 297/447.3 X
3,999,802 A * 12/1976 Powers ..... A47C 3/04 297/447.3
4,305,617 A * 12/1981 Benoit ..... A47C 7/40 297/448.2
4,368,917 A * 1/1983 Urai ..... A47C 7/16 297/452.15
4,506,929 A * 3/1985 Josefek ..... A47C 7/425 297/452.33 X
4,548,441 A * 10/1985 Ogg ..... A47C 3/04 297/448.2 X
4,572,578 A * 2/1986 Perkins ..... A47C 7/46 297/452.32
5,064,247 A * 11/1991 Clark ..... A47C 3/04 297/447.3
5,123,702 A * 6/1992 Caruso ..... A47C 3/12 297/448.2 X
5,154,485 A * 10/1992 Fleishman ..... A47C 7/445 297/446.1
5,314,240 A * 5/1994 Ishi ..... A47C 1/03255 297/452.15
5,383,712 A * 1/1995 Perry ..... A47C 1/032 297/448.2
5,626,394 A * 5/1997 Perry ..... A47C 3/04 297/446.2 X
RE36,335 E * 10/1999 Perry ..... A47C 1/032 297/447.1 X
5,961,184 A * 10/1999 Balderi ..... A47C 7/70 297/448.1
5,997,094 A * 12/1999 Cvek ..... A47C 3/04 297/448.2 X
6,109,696 A * 8/2000 Newhouse ..... A47C 7/42 297/446.2 X
6,132,004 A * 10/2000 Carlino ..... A47C 7/425 297/284.1
6,652,034 B1 * 11/2003 Schramm ..... A47C 7/185 297/452.29
6,808,230 B2 * 10/2004 Buss ..... B60N 2/5657 297/180.12
6,957,860 B1 * 10/2005 Leist ..... A47C 3/04 297/448.2 X
7,111,906 B2 * 9/2006 Heisey ..... A47C 7/22 297/447.3 X
7,320,503 B2 * 1/2008 Eysing ..... A47C 7/46 297/452.15 X
7,413,250 B2 * 8/2008 Connolly ..... A47C 7/46 297/452.3 X
7,681,956 B2 * 3/2010 Huang ..... A47C 3/00 297/448.2 X
2009/0127914 A1 5/2009 Igarashi et al.
2010/0001572 A1 1/2010 Masunaga et al.
2019/0142168 A1 * 5/2019 Liu ..... A47C 7/46 297/301.1
2019/0274431 A1 9/2019 Kumazawa

FOREIGN PATENT DOCUMENTS

JP 2008119247 A 5/2008
JP 2009165661 A 7/2009
JP 2010051384 A 3/2010
JP 2018047138 A 3/2018
WO 2018055781 A1 3/2018

OTHER PUBLICATIONS

Translation of the International Preliminary Report on Patentability (Forms PCT/IB/338, PCT/IB/373, and PCT/ISA/237) for International Patent Application No. PCT/JP2019/021333, dated Dec. 10, 2020, 8 pages.
International Search Report (Form PCT/ISA/210) for International Application No. PCT/JP2019/021333 dated Jul. 16, 2019, 2 pages.
Extended European Search Report for European Patent Application No. 19810495.2, dated Feb. 3, 2022, 7 pages.
Notice of Reasons for Refusal for Japanese Patent Application No. 2018103537, dated Feb. 1, 2022, 8 pages.
Examination Report No. 2 for Australian Patent Application No. 2019279177, dated Apr. 19, 2022, 4 pages.

* cited by examiner

BACKREST AND CHAIR

CROSS-REFERENCE TO RELATED APPLICATION

This application is the U.S. national phase under 35 U.S.C. § 371 of International Application No. PCT/JP2019/021333 filed May 29, 2019, and further claims priority to Japanese Patent Application No. 2018-103537 filed May 30, 2018 wherein the entire disclosures of the foregoing applications are hereby incorporated by reference herein.

TECHNICAL FIELD

The present disclosure relates to a chair with a backrest.

BACKGROUND ART

There are conventional chairs configured to be stackable or nestable. In some cases, a backrest has a reduced thickness in a front-rear direction, in order to reduce a gap in the front-rear direction between chairs when the chairs are stacked. Patent Document 1 below discloses a backrest configured with a relatively thick frame and relatively thin plate-shaped members arranged within the frame.

PRIOR ART DOCUMENTS

Patent Documents

Patent Document 1: Japanese Unexamined Patent Application Publication No. 2010-51384

SUMMARY OF THE INVENTION

Problems to be Solved by the Invention

In a backrest with a thick frame as disclosed in aforementioned Patent Document 1, the frame is likely to have a low flexibility. In particular, since left and right corners of the backrest are less likely to follow body movement, a seated person's action of turning around while keeping seated or stretching out the left or right hand rearward may be hindered.

In one aspect of the present disclosure, it is preferable to propose a backrest that is less likely to obstruct body movement.

Means for Solving the Problems

One aspect of the present disclosure provides a backrest for use in a chair, and comprises a back board arranged in a position to abut a back of a seated person on the chair. A first area including a laterally central area of the back board has a thickness greater than a thickness of a second area of the back board located closer to each of left and right ends than the first area.

This configuration allows the second area to be relatively deformable. Accordingly, particularly when a seated person turns the body rearward, movement of the seated person is less likely to be obstructed by the backrest. Also, when the seated person is seated in a normal posture (a posture of facing forward), the back can be supported by the first area having a relatively high rigidity.

In the above-described backrest, the back board may comprise a region having a thickness that gradually decreases upward. With this configuration, the back board becomes more deformable as a position becomes upper, and the backrest is less likely to obstruct movement of the body.

Also, in the above-described backrest, the back board may comprise a high rigidity portion provided at least in a lower area from a vertical center position at each of the left and right ends of the back board. The high rigidity portion has a rigidity higher than that of a surrounding area of the high rigidity portion in the back board. With this configuration, a lower portion of the backrest can securely support the backrest. Also, an upper portion of the backrest having high flexibility is less likely to obstruct movement of the body.

In the above-described backrest, the backrest may be connected to a seat body of the chair or a support body supporting the seat body by a connecting portion. The connecting portion may be connected to the first area in the backrest. With this configuration, connection with the seat body or the like is achieved using the first area having a relatively high rigidity, and thus the backrest can be held stably.

In the above-described backrest, at least the second area may comprise a flexible structure to improve flexibility of the back board. The first area may comprise no flexible structure. With this configuration, it is possible to achieve an increased flexibility of the second area, while inhibiting decrease in rigidity of the first area.

In the above-described backrest, the back board may comprise a projecting portion projecting rearward at an upper end of the back board. With this configuration, it is possible to hold the projecting portion to carry the backrest (and thus, the chair).

In the above-described backrest, the back board may comprise an area having a thickness gradually decreasing from a lateral center of the back board toward the left and right ends. With this configuration, the flexibility of the back board gradually changes toward the left and right ends of the back board. Accordingly, it is possible to reduce an uncomfortable feeling that may be caused to a seated person due to abrupt changes in flexibility of the back board.

In the above-described backrest, at least a part in a vertical direction of each of the left and right ends of the back board may be a portion having a smallest thickness at a same height of the back board. This configuration can achieve increased flexibility at the ends of the back board.

A main part of the above-described back board may be formed from a material that is a thermoplastic elastomer or a mixture including a thermoplastic elastomer. This configuration can achieve increased flexibility at the ends of the back board.

Another aspect of the present disclosure provides a chair that comprises the above-described backrest. Such chair can achieve the effects brought by the above-described backrest.

EXPLANATION OF REFERENCE NUMERALS

Figure 1B:
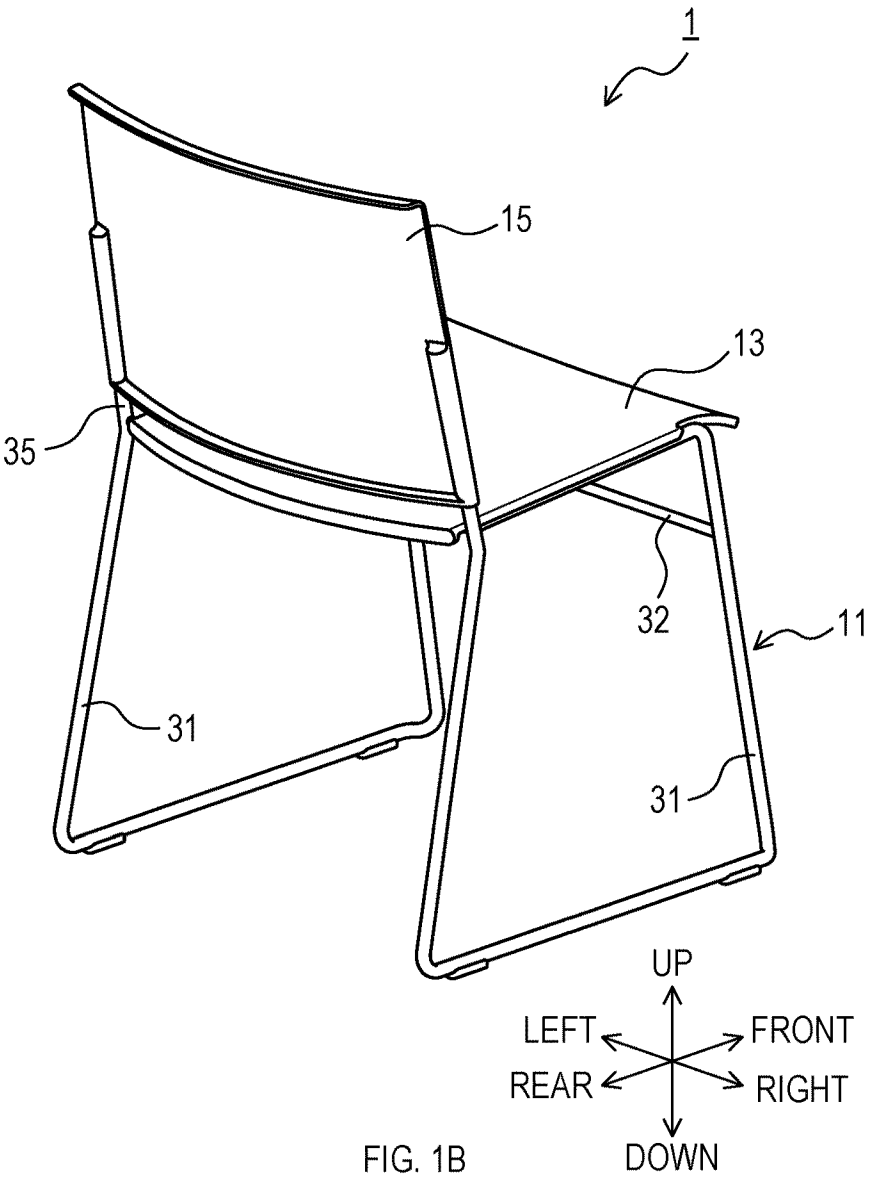
FIG. 1B is a rear side perspective view of the chair of the embodiment.
Figure 1A:
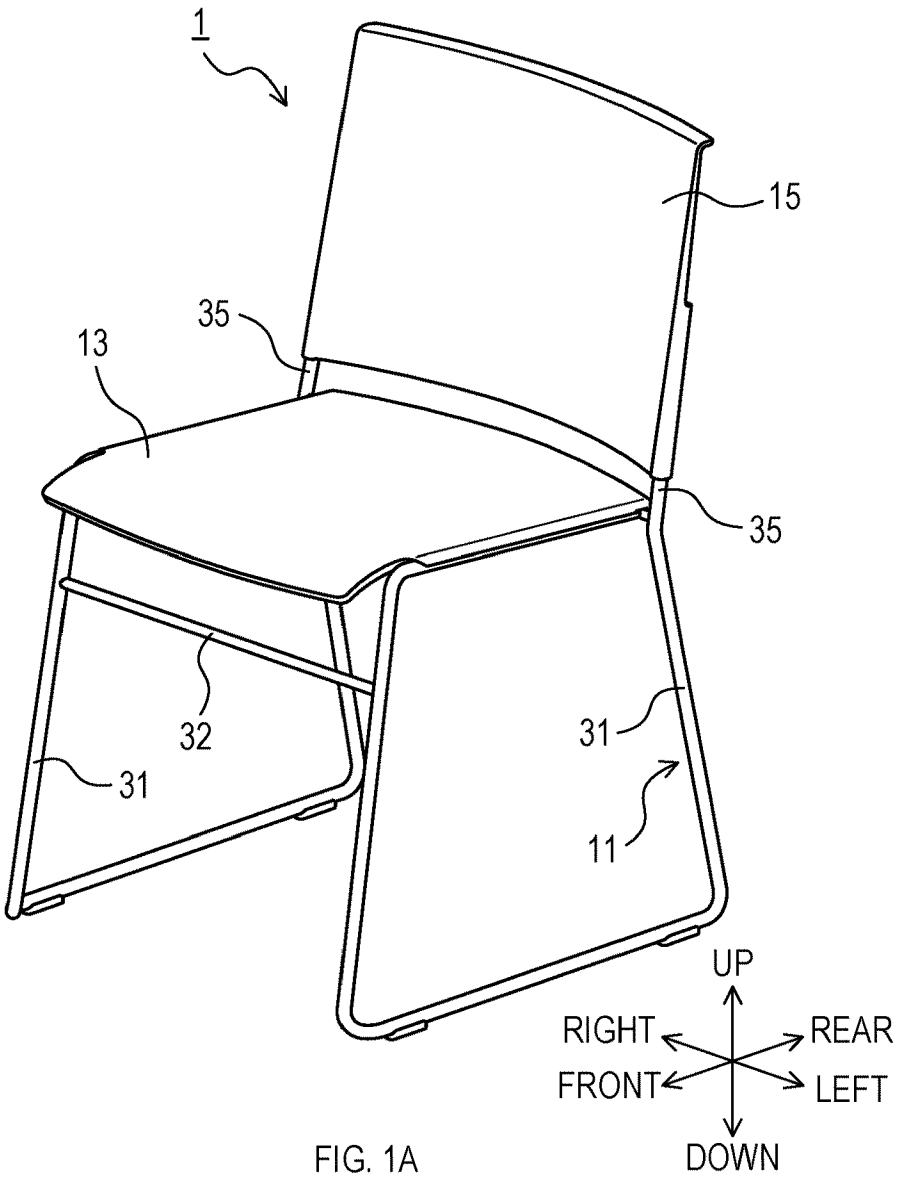
FIG. 1A is a front side perspective view of a chair of an embodiment.
Figure 2A:
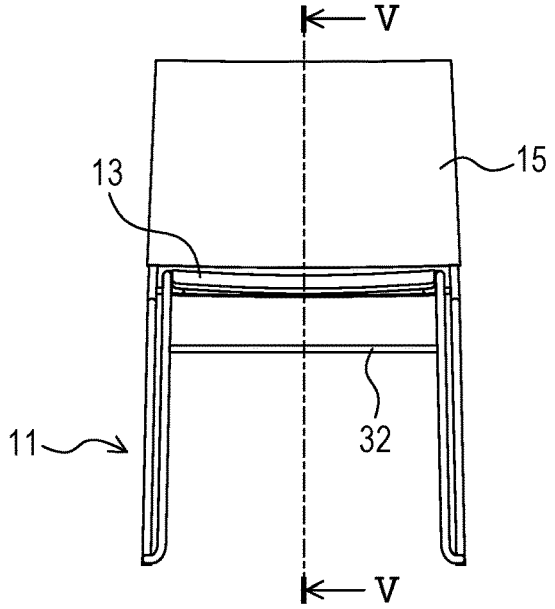
FIG. 2A is a front view of the chair of the embodiment.
Figure 2B:
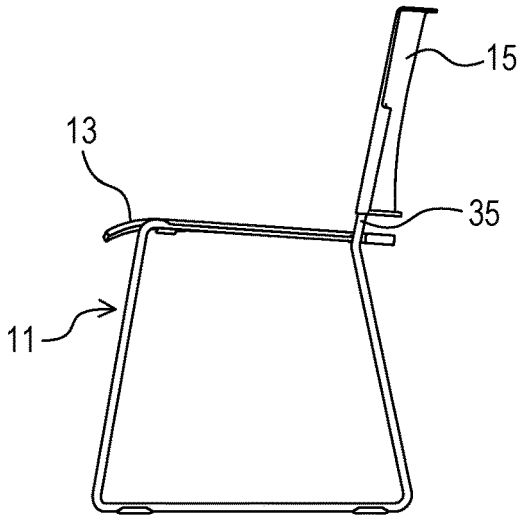
FIG. 2B is a side view of the chair of the embodiment.
Figure 2C:
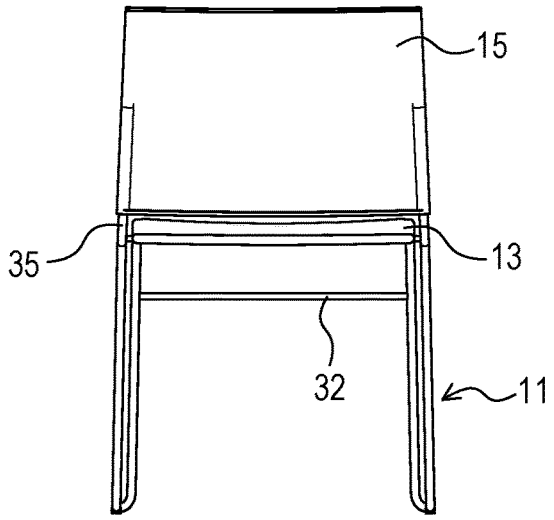
FIG. 2C is a rear view of the chair of the embodiment.
Figure 2D:
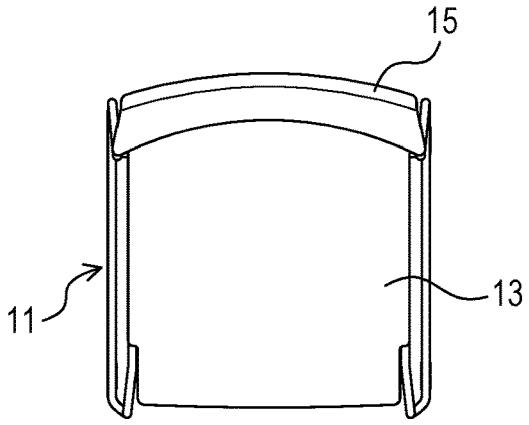
FIG. 2D is a plan view of the chair of the embodiment.
Figure 2E:
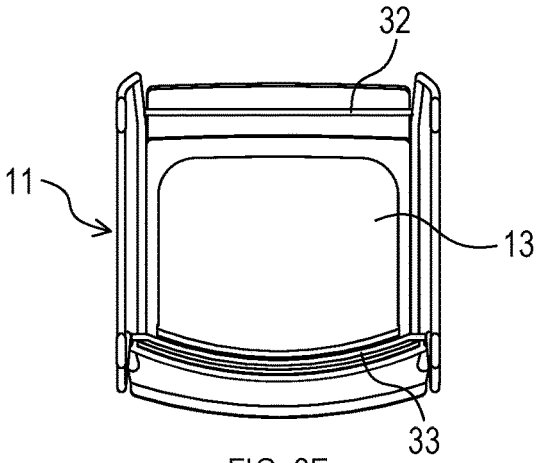
FIG. 2E is a bottom view of the chair of the embodiment.

1 . . . chair, 11 . . . support body, 13 . . . seat body, 15 . . . backrest, 31 . . . pipe body, 32 . . . front side connector, 33 . . . rear side connector, 35 . . . connecting portion, 41 . . . back board, 42 . . . pipe holder, 43 . . . projecting portion, 44 . . . bent portion, 51 . . . first area, 52 . . . second area, 53 . . . thinnest portion, 101 . . . backrest, 103 . . . first area, 105 . . . second area, 111 . . . backrest, 113 . . . high rigidity portion, 121 . . . backrest, 123 . . . first area, 125 . . . second area, 127 . . . connecting portion, 131 . . . backrest, 133 . . . back board, 135 . . . first area, 137 . . . second area, 139 . . . through hole, 141 . . . dimple, 151 . . . backrest, 153 . . . back board, 155 . . . first area, 157 . . . second area, 159 . . . slit

MODE FOR CARRYING OUT THE INVENTION

A description will be given of embodiments of the present disclosure with reference to the drawings.

1. Embodiment

1-1. Overall Configuration

As shown in FIG. 1A to FIG. 2E, a chair 1 comprises a support body 11, a seat body 13, a backrest 15, and other components.

In the present embodiment, configurations of respective components may be described using directions, such as a front-rear direction, a left-right (lateral) direction, and an up-down (vertical) direction, and these directions are indicated with respect to a user who is normally seated on the chair 1. That is, front is a direction that the seated user faces. The chair 1 is left-right symmetric.

The support body 11 comprises paired left and right pipe bodies 31 each formed by bending a tubular metal pipe, and bar-shaped front side connector 32 and rear side connector 33 each connecting the paired pipe bodies 31. The paired pipe bodies 31 each form a substantially rectangular ring shape when viewed from left or right side. The seat body 13 is supported by upper ends of the paired pipe bodies 31 and the rear side connector 33.

The seat body 13 is substantially rectangular when seen in a plan view, and is configured to allow a user to be seated thereon. Left and right ends, and a rear end of the seat body 13 are connected to the respective upper ends of the paired pipe bodies 31 and the rear side connector 33, and thereby the seat body 13 is fixed to the support body 11.

Each of the paired pipe bodies 31 comprises a connecting portion 35 that deviates from the rectangular ring shape and projects upward from a portion connecting with the rear side connector 33. The backrest 15 is connected to the support body 11 by the left and right connecting portions 35, and thereby secured to the support body 11 through the left and right connecting portions 35.

1-2. Configuration of Backrest

Figure 3C:
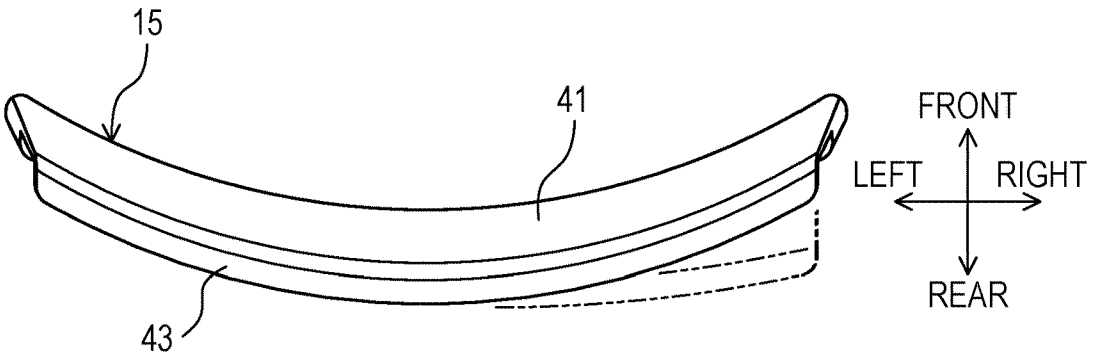
FIG. 3C is a plan view of the backrest of the embodiment.
Figure 3A:
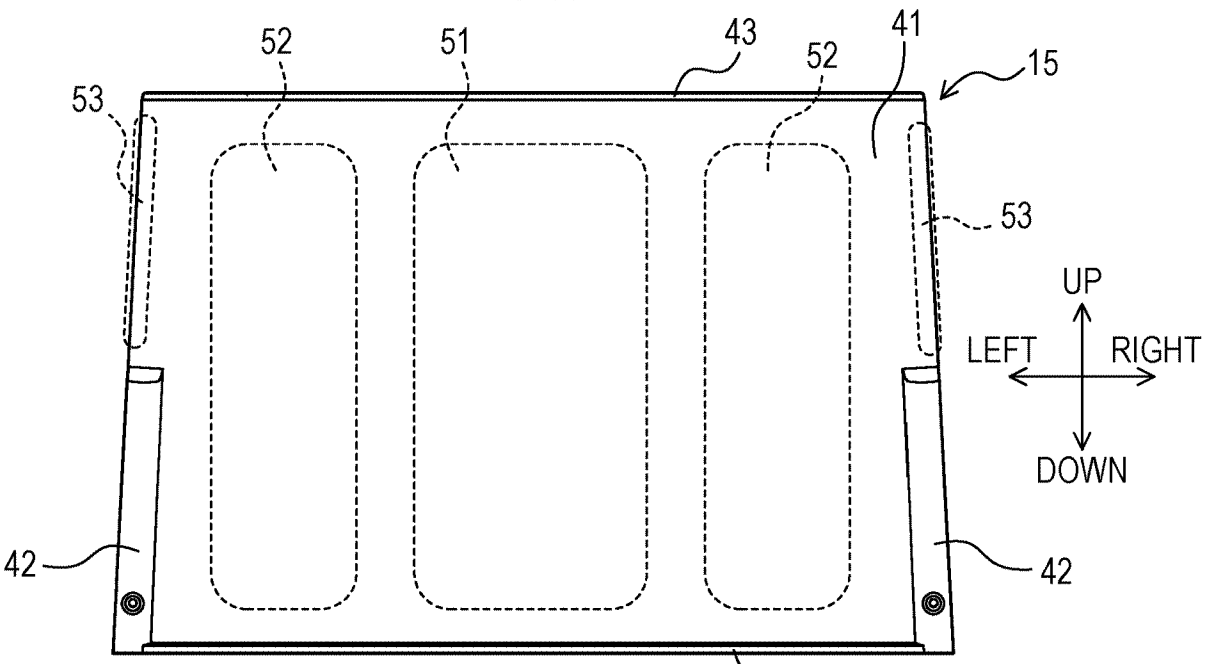
FIG. 3A is a rear view of a backrest of the embodiment.
Figure 3B:
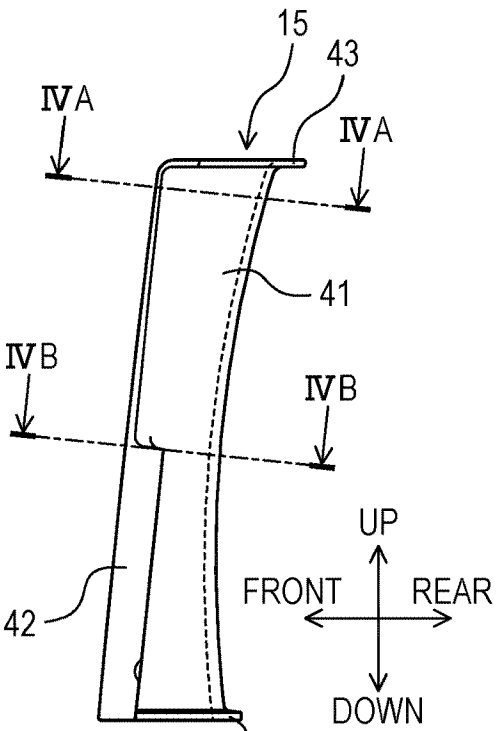
FIG. 3B is a side view of the chair of the embodiment.

As shown in FIG. 3A to FIG. 3C, the backrest 15 for use in a chair is substantially rectangular in a front view. Also, when viewed in a plan view, the backrest 15 forms a gentle curve such that both of left and right ends are positioned forward and a central part positioned rearward.

The backrest 15 comprises a back board 41, paired pipe holders 42, a projecting portion 43, and a bent portion 44. The back board 41 has a substantially rectangular shape. The paired pipe holders 42 are provided at left and right ends of the back board. The projecting portion 43 is provided at an upper end of the back board. The bent portion 44 is provided at a lower end of the back board.

The back board 41 is arranged in a position to abut the back of a seated person on the chair 1.

Figure 4A:
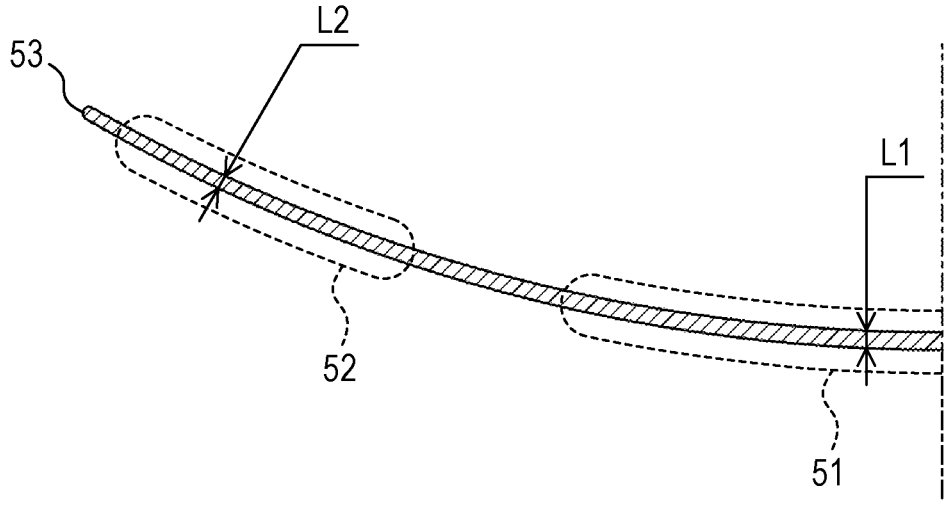
FIG. 4A is a IVA-IVA sectional view of FIG. 3B.
Figure 4B:
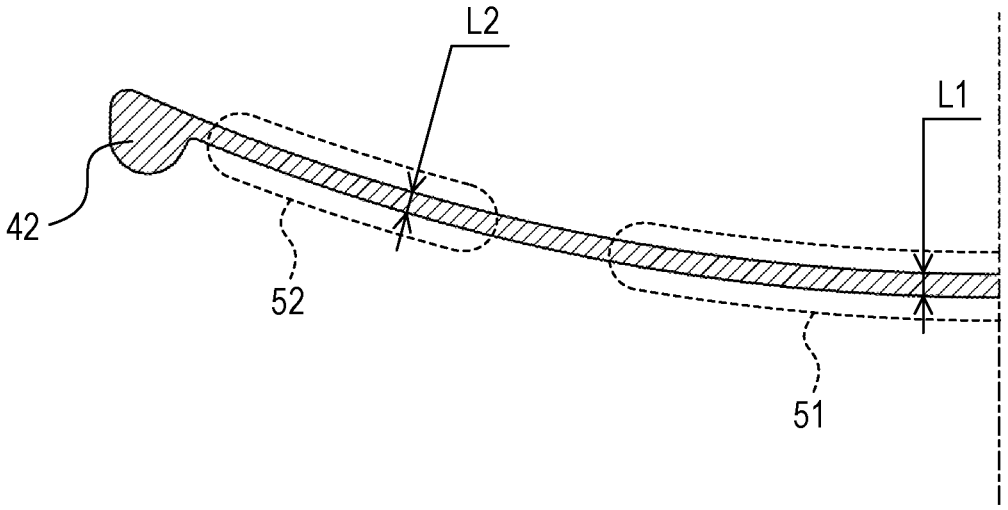
FIG. 4B is a IVB-IVB sectional view of FIG. 3B.

A laterally central area of the back board 41 is a first area 51, and areas located closer to the left and right ends of the back board 41 than the first area 51 are second areas 52. As shown in FIG. 4A and FIG. 4B, the first area 51 has a thickness L1 greater than a thickness L2 of the second area 52. Also, as shown in FIG. 4A, an upper area in a vertical direction of each of the left and right ends of the back board 41 is a thinnest portion 53 having a smallest thickness at a same height of the back board 41.

More specifically, the thickness of the back board 41 gradually decreases from a lateral center of the back board 41 toward the left and right ends except for areas where the pipe holders 42 are formed. In other words, the thickness of the first area 51 is greater than the thickness of the second area 52, and the thickness also varies within each of the first area 51 and the second area 52 depending on a lateral position therein.

A material for a main part of the back board 41 is a thermoplastic elastomer. The material for forming the back board 41 may be a mixture including a thermoplastic elastomer.

Figure 5:
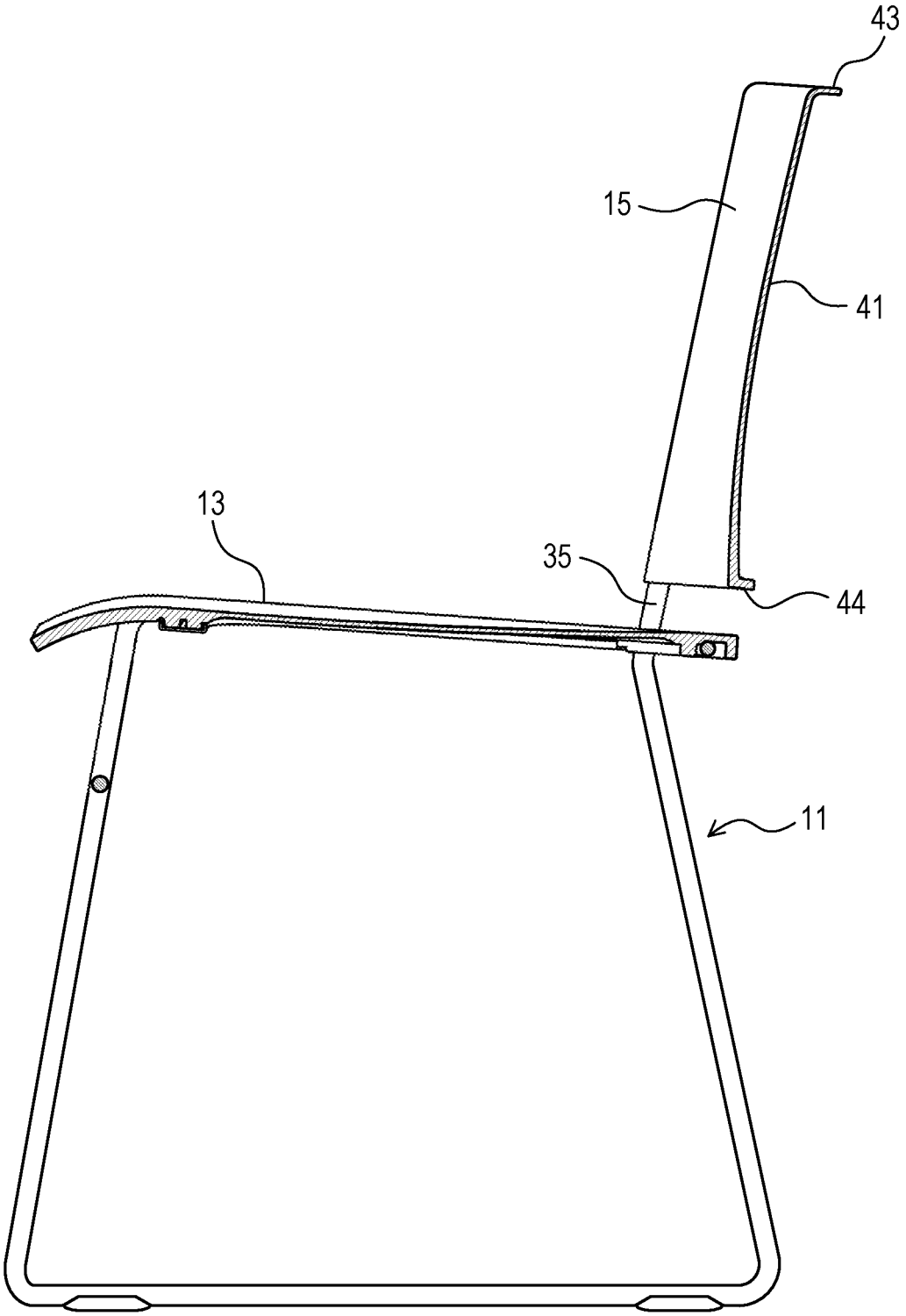
FIG. 5 is a V-V sectional view of FIG. 2A.

As shown in FIG. 5, the back board 41 has a thickness greatest at a lower end and gradually decreasing upward. As shown in FIG. 5, the thickness of the back board 41 decreases upward at any position along the lateral direction.

The paired pipe holders 42 are provided at the left and right ends of the back board 41 in a lower area from a vertical center position. The paired pipe holders 42 each have a greater thickness than a surrounding area, and protrude rearward from the back board 41. The connecting portion 35 is inserted in each of the paired pipe holders 42. Thus, the paired pipe holders 42 each have a higher rigidity than the surrounding area of the pipe holder 42 in the back board 41. The paired pipe holders 42 each correspond to a high rigidity portion.

The projecting portion 43 is a plate-shaped portion projecting rearward across an entire laterally extending area of the upper end of the back board 41. The bent portion 44 is a plate-shaped member projecting rearward across an entire laterally extending area of the lower end of the back board 41.

1-3. Effects

According to the embodiment detailed above, the following effects can be obtained.

(1a) In the chair 1, the second area 52 of the back board 41 is relatively more deformable than the first area 51. Thus, for example, as indicated by two-dotted chain lines in FIG. 3C, end portions of the back board 41 are easily elastically deformable rearward. Accordingly, for example, when a seated person turns the body rearward, movement of the seated person is less likely to be obstructed. Also, when the seated person faces forward, the first area 51 having a high rigidity sufficiently supports the back, and thus, it is possible to reduce impairment of the function of the backrest due to excessive flexibility of the backrest.

(1b) Since the back board 41 gradually becomes thinner upward, an upper part of the back board 41 has a relatively high flexibility. Accordingly, when a seated person moves the body, obstruction of the movement by the back board 41 can be significantly reduced.

(1c) The backrest 15 comprises the pipe holders 42 at two left and right positions of its lower end. The pipe holders 42 have high rigidity, and thus, provide high rigidity of a lower part of the backrest 15 that provides small influence on movements of a seated person, thereby allowing inhibition of unnecessary flexibility of the backrest 15.

(1d) The backrest 15 comprises the projecting portion 43 and the bent portion 44, and thus can inhibit deformation of the shape of the backrest 15 caused by an excessive reduction in rigidity of the backrest 15. The backrest 15 is formed from a material containing an elastomer, and thus has a high flexibility. Even in this case, the projecting portion 43 and the bent portion 44 sufficiently achieve maintenance of the shape.

(1e) Since the backrest 15 comprises the projecting portion 43, the projecting portion 43 can be used as a handhold for carrying the chair 1. Particularly, it is useful when carrying a relatively light chair, such as a stacking chair and a pipe chair.

(1f) Since the thickness of the back board 41 gradually decreases from the lateral center of the back board 41 toward the left and right ends, it is possible to reduce an uncomfortable feeling caused to a seated person due to abrupt changes in flexibility of the back board 41. Also, it is possible to inhibit concentration of stress at one place when a load is applied to the back board 41, and thus to inhibit breakage of the back board 41.

The phrase "the thickness gradually decreases" herein does not only mean smooth changes in thickness, but also includes multiple stepwise changes, for example, at three or more levels. Also, in some of the entire area, there may be an area with no change in thickness or an area having a locally large thickness.

(1g) The upper area above each of the paired pipe holders 42 at the left and right ends of the backrest 15 is the thinnest portion 53 having the smallest thickness at the same height. Since the left and right ends of the back board 41 do not have high rigidity as described above, reduction in flexibility at the both ends of the backrest 15 can be inhibited.

2. Other Embodiments

Although an embodiment of the present disclosure has been described above, it is to be understood that the present disclosure is not limited to the above-described embodiment, but may be in various forms within the technical scope of the present disclosure.

(2a) A specific configuration of the backrest is not limited to the configuration shown in the above-described embodiment. For example, the backrest is not required to be rectangular. Various shapes, such as a rounded shape, and a bilaterally asymmetric shape, may be employed for the backrest. Also, there is no limitation to the configuration of the projecting portion 43 or the bent portion 44. For example, respective arrangement positions, projecting amounts, thicknesses, widths, etc. of the projecting portion 43 and the bent portion 44 may be specified optionally. Further, the backrest 15 may include one or none of the projecting portion 43 and the bent portion 44.

Figure 6A:
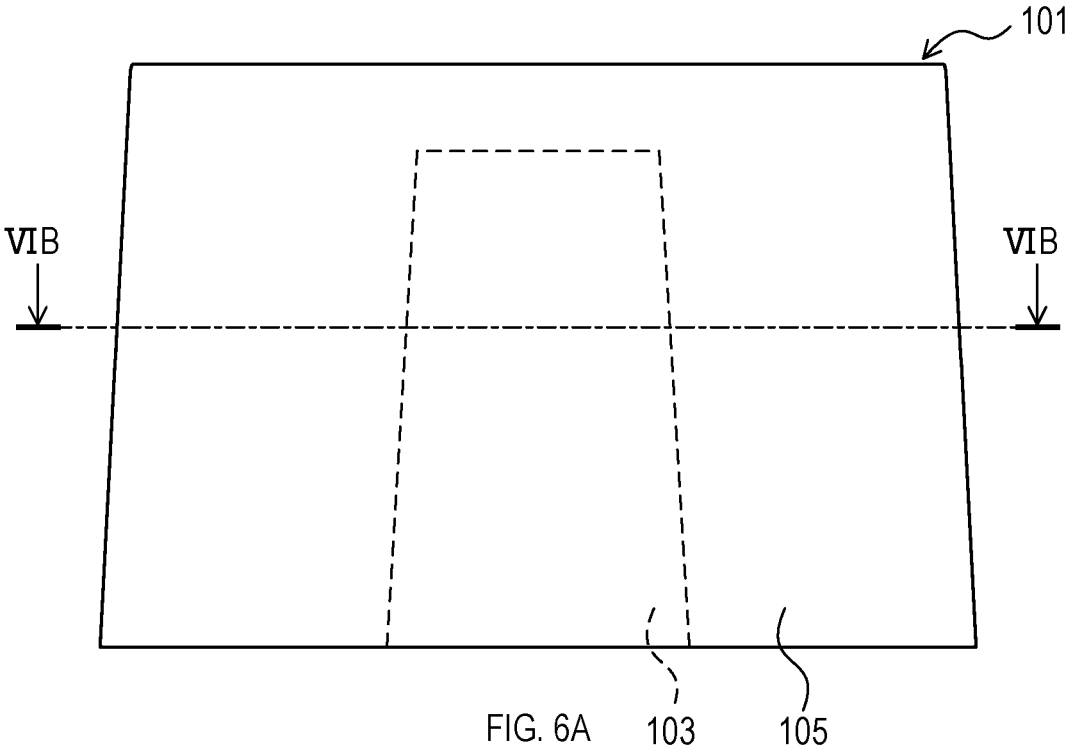
FIG. 6A is a front view showing a variation of the backrest.
Figure 6B:
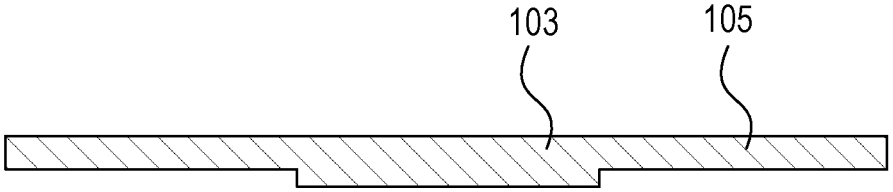
FIG. 6B is a VIB-VIB sectional view of FIG. 6A.

(2b) In the above-described embodiment, an example configuration is shown in which the thickness of the back board 41 gradually decreases toward the left and right ends. However, there is no particular limitation to the specific configuration of the back board that includes the second area thinner than the first area. For example, there is no particular limitation to a specific size of the first area as long as the first area includes a laterally central area of the back board. The first area may be a relatively small area in a vicinity of the laterally central area. Also, there is no particular limitation to size of the second area, as long as the second area is located closer to each of the left and right ends than the first area. As in a backrest 101 shown in FIG. 6A to FIG. 6B, a first area 103 and a second area 105 may have respective fixed thicknesses. Between the first area and the second area, there may be an area having a thickness greater or smaller than the thicknesses of the first area and the second area. The configuration of the back board may be such that the thickness decreases toward the left and right ends in a stepwise manner. The configuration may be such that the thickness of the back board gradually decreases across the back board along the lateral direction, or the configuration may be such that the thickness of the back board gradually decreases in a part of the back board along the lateral direction.

Further, the first area and the second area may cover the entire area of the back board in the vertical direction, or may cover a part of the area of the back board in the vertical direction. For example, the first area and the second area may cover a range except for an upper end portion and a lower end portion of the back board.

(2c) In the above-described embodiment, an example configuration is shown in which the thickness of the entire back board 41 gradually decreases upward. However, the back board need not be configured in such a manner across the entire area in the vertical direction as long as the back board includes a region in which the thickness gradually decreases upward. For example, the back board may include the aforementioned configuration in some part along the lateral direction of the back board, or may include the aforementioned configuration in some part along the vertical direction of the back board. In this regard, if at least the second area includes the aforementioned configuration, an effect can be obtained that obstruction of movement of a seated person is reduced. Further, the back board need not include a region in which the thickness gradually changes in the vertical direction.

(2d) In the above-described embodiment, an example configuration is shown in which the paired pipe holders 42 are provided, each as a high rigidity portion, from the lower end to the center. However, the configuration of the high rigidity portion is not limited to that in the above-described embodiment. For example, there is no particular limitation to a specific configuration of the high rigidity portion as long as the rigidity is higher than that of the surroundings. Specifically, the high rigidity portion may have a thickness greater than the surroundings. The high rigidity portion may be configured with a member having a rigidity higher than that of the surroundings of the high rigidity portion, or may include a member having a rigidity higher than that of the surroundings of the high rigidity portion.

Figure 7:
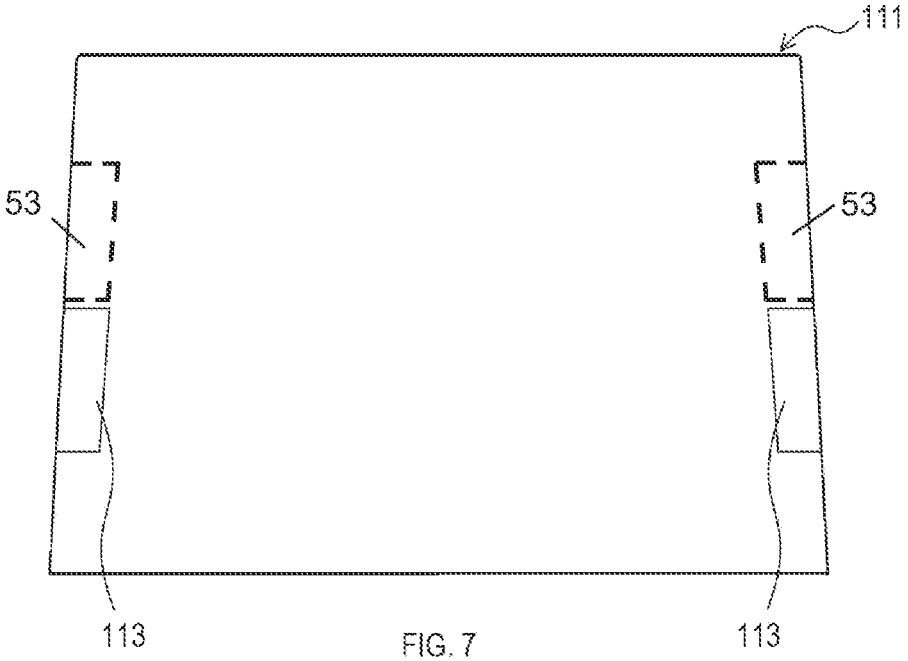
FIG. 7 is a front view showing a variation of the backrest.

The high rigidity portion may be provided at least in respective lower areas of at least the left and right ends of the back board. For example, as a backrest 111 shown in FIG. 7, high rigidity portions 113 may be provided in positions apart from respective lower ends of the left and right ends. In certain embodiments, as further shown in FIG. 7, upper areas from the vertical center of each of the left and right ends of the back board are reduced thickness portions 53 having the smallest thickness at a same (i.e., selected) height of the back board. Also, the high rigidity portions may be provided at respective upper areas of the left and right ends of the back board. Further, no high rigidity portions need to be provided at both ends in the lateral direction.

Figure 8:
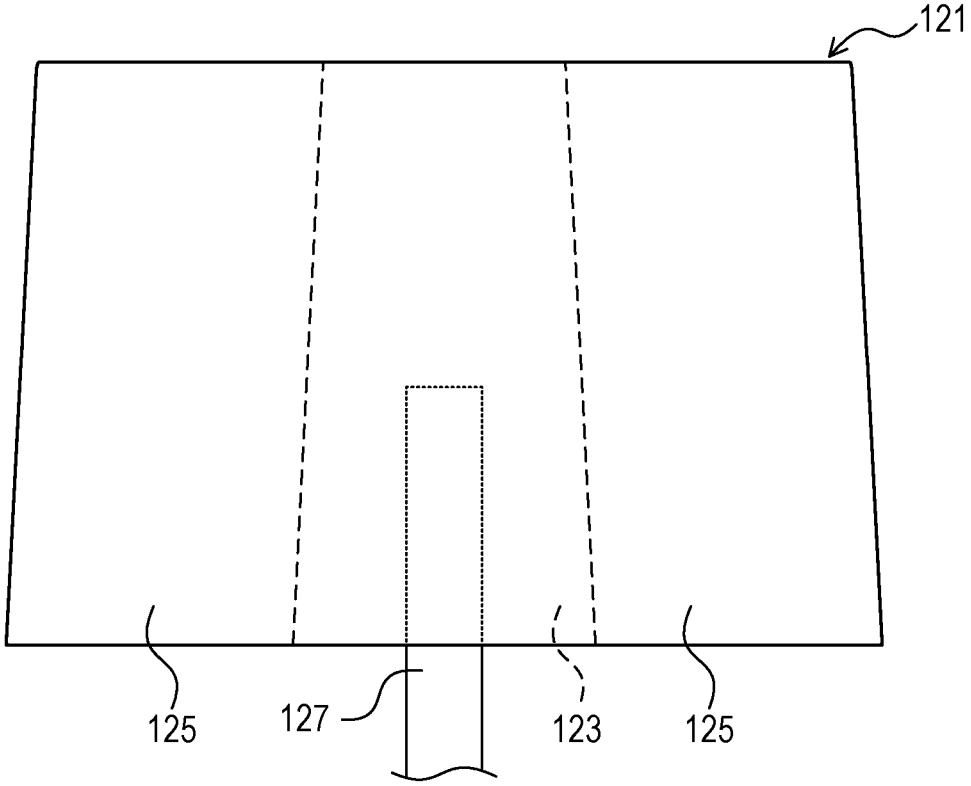
FIG. 8 is a front view showing a variation of the backrest.

(2e) In the above-described embodiment, an example configuration is shown in which the connecting portion 35 is provided at each of the left and right ends of the back board. However, the position where the connecting portion is provided in the back board need not be located at the left and right ends. For example, as a backrest 121 shown in FIG. 8, a connecting portion 127 may be connected not to a second area 125 but to a first area 123.

Also, the connecting portion may be connected to the seat body of the chair or the support body supporting the seat body. Further, the backrest and the seat body, or the backrest and the support body may be connected through another member along with the connecting portion. In other words, the connecting portion is a component to define a positional relationship between the seat body and the backrest of the chair.

Figure 9A:
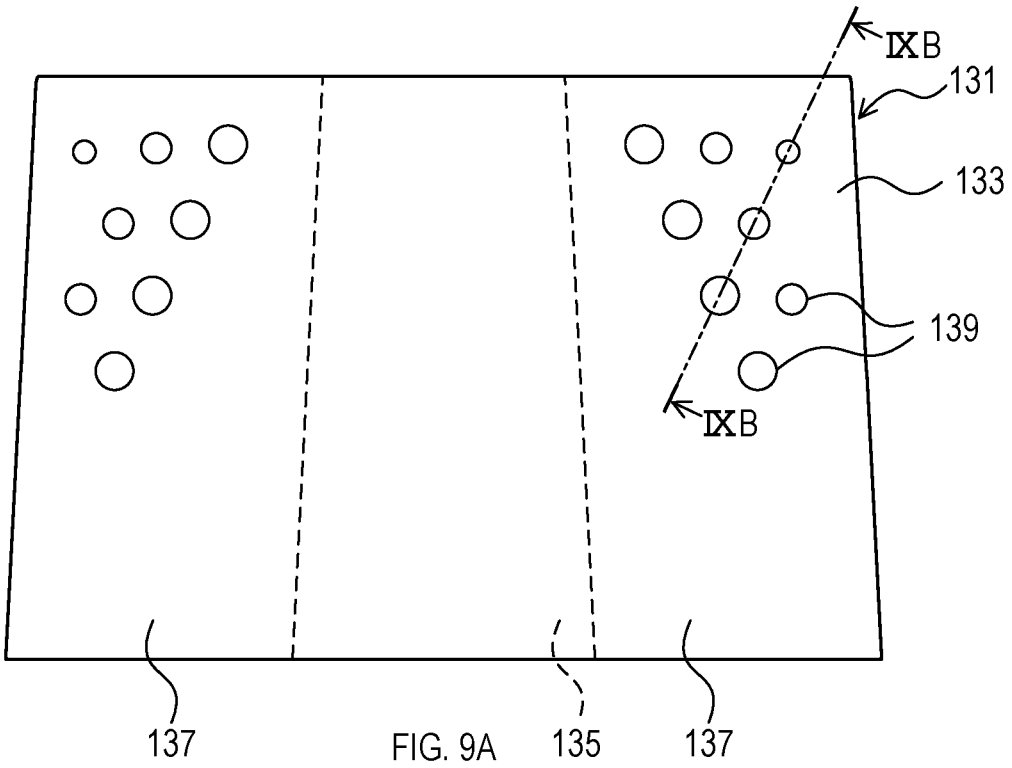
FIG. 9A is a front view showing a variation of the backrest.
Figure 9B:
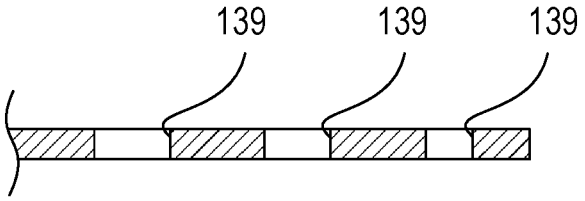
FIG. 9B is a IXB-IXB sectional view of FIG. 9A.

(2f) The back board may comprise a flexible structure to achieve an improved flexibility. A configuration may be such that the flexible structure is provided in the second area and not provided in the first area. For example, a backrest 131 shown in FIG. 9A to FIG. 9B comprises through-holes 139 penetrating from a front surface to a rear surface of a back board 133 at least in a second area 137. On the other hand, no through-hole is formed in a first area 135. With this configuration of the back board, an improved flexibility of the second area 137 can be achieved by the through holes, and reduction in rigidity of the first area 135 can be inhibited. Also, since there is no through-hole in the first area 135 that is likely to abut a back in an ordinary posture, it is possible to inhibit a seated person from having an uncomfortable feeling by through-holes. It may be configured such that a hole diameter of the through hole 139 becomes smaller as the through hole 139 is positioned closer to a lateral outer side. It may be configured such that the hole diameter of the through hole 139 becomes smaller as the through hole 139 is positioned closer to a vertical upper side. Alternatively, it may be configured such that the hole diameter of the through hole 139 becomes larger as the through hole 139 is positioned closer to the lateral outer side. It may be configured such that the hole diameter of the through hole 139 becomes larger as the through hole 139 is positioned closer to the vertical upper side.

Figure 9C:
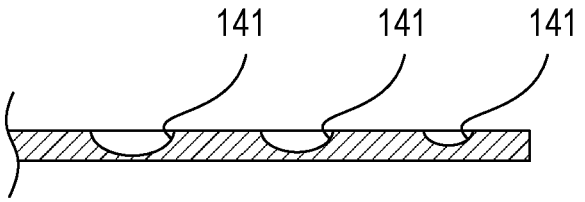
FIG. 9C is a sectional view showing another variation.

Further, as shown in FIG. 9C, dimples 141 may be formed in place of the through hole 139. In this case, it may be configured such that the dimple 141 becomes smaller as the dimple 141 is positioned closer to the lateral outer side. It may be configured such that the dimple 141 becomes smaller as the dimple 141 is positioned closer to the vertical upper side. Alternatively, it may be configured such that the dimple 141 becomes larger as the dimple 141 is positioned closer to the lateral outer side. It may be configured such that the dimple 141 becomes larger as the dimple 141 is positioned closer to the vertical upper side.

Figure 10:
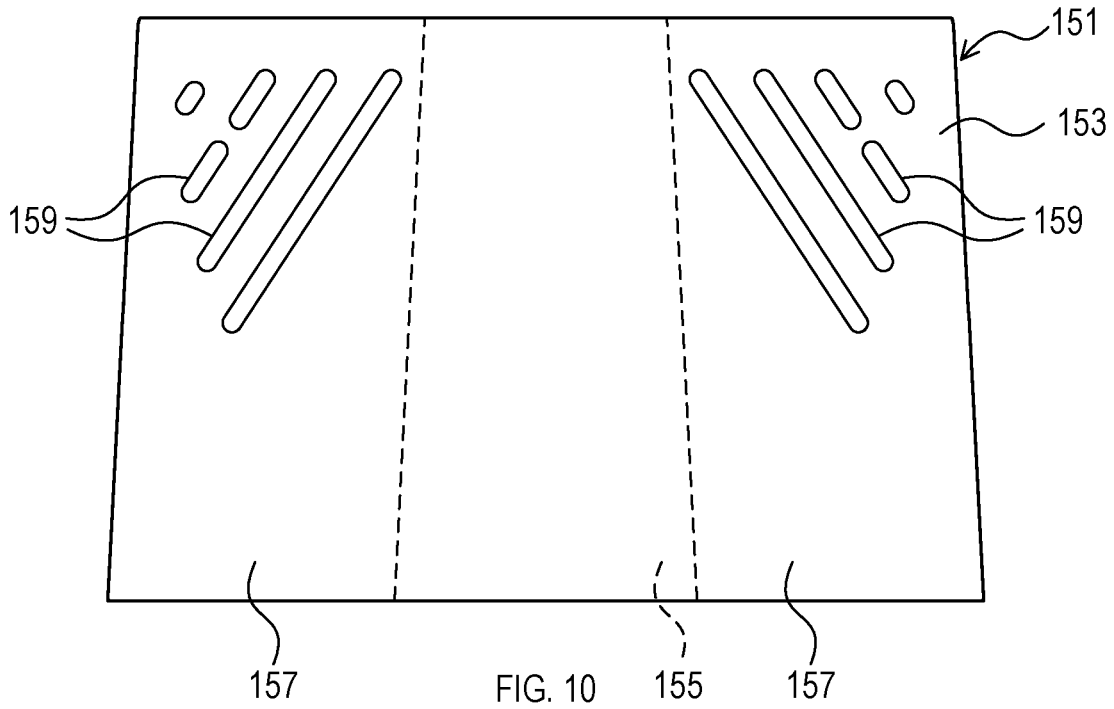
FIG. 10 is a front view showing a variation of the backrest.

Moreover, as a backrest 151 shown in FIG. 10, at least a second area 157 may comprise slits 159 penetrating from a front surface to a rear surface of a back board 153. A first area 155 need not comprise any slits.

(2g) In the above-described embodiment, an example configuration is shown in which the upper area from the vertical center of each of the left and right ends the back board is the thinnest portion 53 having the smallest thickness at the same height of the back board. However, the position of the thinnest portion 53 is not limited to the position in the embodiment, but may be at least any vertical part of the left and right ends of the back board to achieve flexibility in a periphery of the back board. Also, the thinnest portion 53 need not be provided to the backrest.

The invention claimed is:

1. A backrest for use in a chair, the backrest comprising:

a back board arranged in a position to abut a back of a seated person on the chair, wherein a first area including a laterally central area of the back board has a board thickness greater than a board thickness of a second area of the back board located closer to each of left and right ends of the back board than the first area, wherein the back board comprises a high rigidity portion provided at each of the left and right ends of the back board at least in a lower area from a vertical center position, wherein the high rigidity portions have a rigidity higher than that of surrounding areas of the high rigidity portions in the back board, and wherein the back board comprises reduced thickness portions that are provided above the high rigidity portions at left and right ends of the back board, the reduced thickness portions having a smallest board thickness at a selected height of the back board.

2. The backrest according to claim 1, wherein the back board comprises a region having a board thickness that gradually decreases upward.

3. The backrest according to claim 1, wherein the backrest is connected to a seat body of the chair or a support body supporting the seat body by a connecting portion having a column shape extending in a vertical direction, and wherein the connecting portion is connected to the first area of the backrest.

4. The backrest according to claim 1, wherein the back board comprises a projecting portion projecting rearward at an upper end of the back board.

5. The backrest according to claim 1, wherein the back board comprises an area having a board thickness gradually decreasing from a lateral center of the back board toward the left and right ends.

6. The backrest according to claim 1, wherein a main part of the back board is formed from a material that is a thermoplastic elastomer or a mixture including a thermoplastic elastomer.

7. A chair comprising the backrest according to claim 1.

8. The backrest according to claim 1, wherein the left and right ends of the back board are configured to be deformable in a rearward direction.

9. The backrest according to claim 1, wherein at least the second area comprises a flexible structure to improve flexibility of the back board, and the first area is devoid of any flexible structure.

* * * * *